United States Patent [19]

Hirschfeld

[11] Patent Number: 4,666,163

[45] Date of Patent: May 19, 1987

[54] CARD GAME

[75] Inventor: Uri Hirschfeld, Doar Na Merom Hagalil, Israel

[73] Assignee: Orda Industries (1969) Ltd., Doar Na Merom Hagalil, Israel

[21] Appl. No.: 849,126

[22] Filed: Apr. 7, 1986

[30] Foreign Application Priority Data

Apr. 9, 1985 [IL] Israel ..... 74845

[51] Int. Cl.[4] ..... A63F 1/02

[52] U.S. Cl. ..... 273/293; 273/157 R; 434/171; 434/205; 446/108; 446/125

[58] Field of Search ..... 273/293, 294, 157 R; 434/170, 171, 205; 446/108, 116, 125

[56] References Cited

U.S. PATENT DOCUMENTS

| | | | |
|---|---|---|---|
| D. 222,490 | 10/1971 | Alaska | 273/293 X |
| 2,911,220 | 11/1959 | Irwin | 273/293 X |
| 3,245,687 | 4/1966 | Irwin | 273/293 |
| 3,798,797 | 3/1974 | Mandel | 434/171 |
| 3,937,472 | 2/1976 | Rice | 273/157 R |
| 4,067,580 | 1/1978 | Tzeng | 273/294 X |

FOREIGN PATENT DOCUMENTS

| | | | |
|---|---|---|---|
| 1243060 | 8/1960 | France | 273/293 |

*Primary Examiner*—Anton O. Oechsle

*Attorney, Agent, or Firm*—Benjamin J. Barish

[57] ABSTRACT

A card game comprises a set of cards with each card being formed with a slit along its mid-line starting from one edge and extending for about one-half its width towards its opposite edge such as to permit each card to be inserted via its slit into the slit of each other card in the set to form a pair with one-half of one card aligned with and exposed to view with the other half of the other card. Each card has indicia on each half of the card on opposite sides of its respective slit. The indicia on the half of each card on one side of the slit is non-validly complementary with the indicia on the other half of the card on the other side of its slit, but is validly complementary with the indicia on some, but not all, of the other cards of the set to form a valid card pair therewith when the two cards are inserted into each other via their respective slits.

20 Claims, 7 Drawing Figures

FIG.1
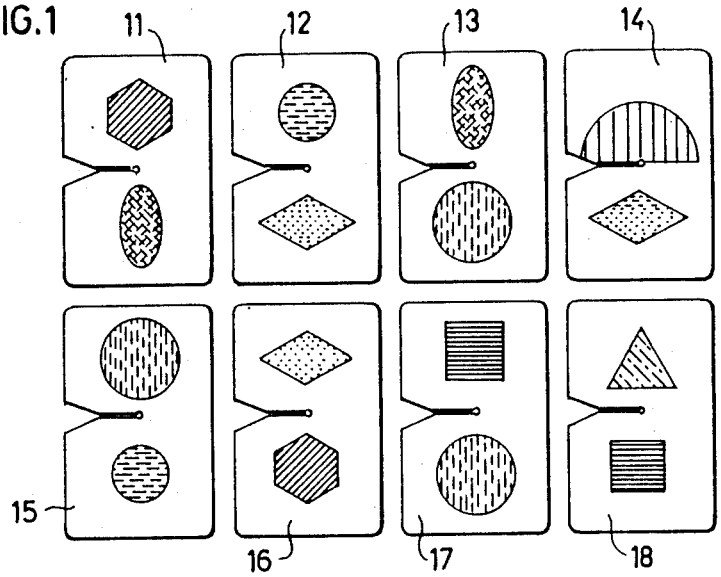
FIG 2
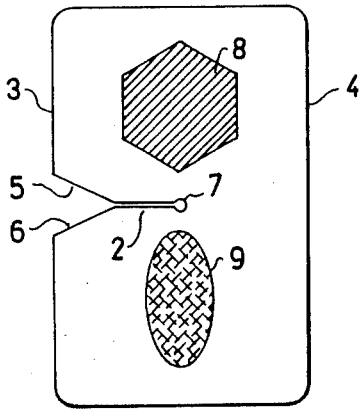
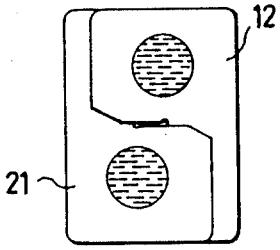
FIG 3a
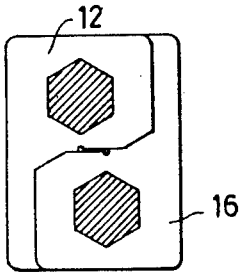
FIG 3b

FIG 4
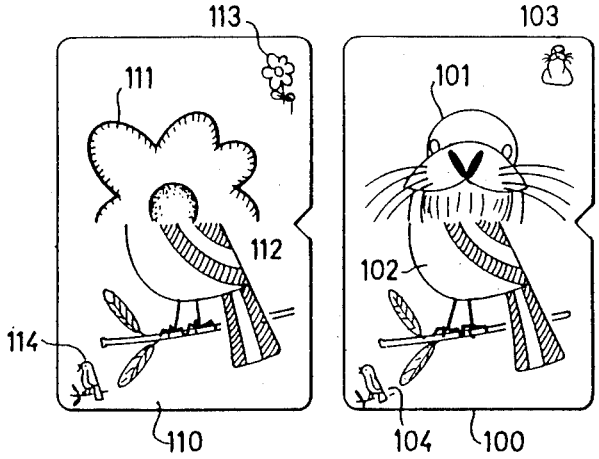
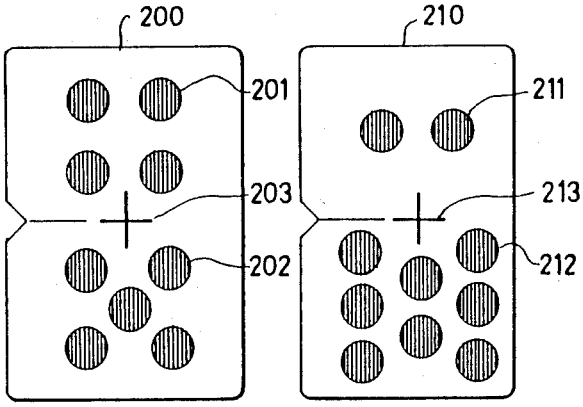
FIG. 5
FIG. 6
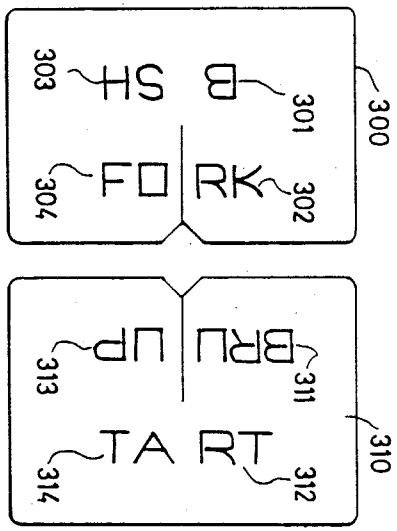

CARD GAME

BACKGROUND OF THE INVENTION

The present invention relates to card games, an object of the present invention being to provide a novel card game having an educational aspect as well as an entertaining aspect when played.

SUMMARY OF THE INVENTION

According to the invention, there is provided a card game comprising a set of cards, each card being formed with a slit along its mid-line starting from one edge and extending for about one-half its width towards its opposite edge such as to permit each card to be inserted via its slit into the slit of each other card in the set to form a pair, with one-half of one card aligned with and exposed to view with the other half of the other card; each card having indicia on each half of the card on opposite sides of its respective slit; the indicia on the half of each card on one side of the slit being non-validly complementary with the indicia on the other half of the card on the other side of its slit, but being validly complementary with the indicia on some, but not all, of the other cards of the set to form a valid card pair therewith when the two cards are inserted into each other via their respective slits.

Several embodiments of the invention are described below for purposes of example. Thus, described below are card games in which the indicia on each half of each card illustrates: a geometrical configuration, a valid card pair having matching configurations; one-half of an object, a valid card pair illustrating the complete object; a plurality of letters forming an incomplete word, the letters of a valid card pair constituting the letters of one or more complete words; and a mathematical number, the numbers in a valid card pair illustrating a valid mathematical relationship.

The card game may be played according to various rules, one set of rules being set forth below for purposes of example. The players, when playing the game, exercise not only skill and ability in visualizing and associating the various indicia on the cards, but also strategy in determining when to make valid card pairs and also which cards to use in making such a pair.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates eight cards of a complete set in a card game constructed in accordance with the present invention, the complete card game set including 56 cards;

FIG. 2 illustrates the structure of one of the cards in the card set of FIG. 1;

FIGS. 3*a* and 3*b* illustrate two valid card pairs each including two cards of those illustrated in FIG. 1; and FIGS. 4, 5 and 6 illustrate the indicia on selected cards of three variations in the card game of FIGS. 1 and 2.

DESCRIPTION OF PREFERRED EMBODIMENTS

With reference first to FIG. 1, this figure illustrates eight cards of a total of 56 cards in the card set. All the cards in the card set include the same card structure but different indicia printed on the card.

The structure of each card is more particularly illustrated in FIG. 2, wherein it will be seen that the card is formed with a slit 2 along its mid-line starting from one edge 3 and extending for about one-half of its width towards its opposite edge 4. Each card in the complete set may be inserted via its slit 2 into the slit of each other card in the set to form a pair, as shown in FIGS. 3*a* and 3*b*, with one half of one card aligned with and exposed to view with the other half of the other card. To facilitate the insertion of one card into the other, slit 2 of each card is formed with tapered edges 5, 6, which taper outwardly towards edge 3 of the card. Slit 2 in each card terminates at its inner edge in a further slit 7 extending perpendicularly to slit 2.

Each card includes indicia printed thereon on each of its halves on the opposite sides of its slit 2. The indicia in the card game illustrated in FIGS. 1 and 2 are in the form of geometrical shapes. Thus, the card illustrated in FIG. 2 includes a hexagon 8 on its upper half and an ellipse 9 on its lower half.

FIG. 1 illustrates eight cards of a complete set (of 56 cards) but these eight cards illustrate all the different geometrical configurations included in the cards of a complete set. In this example there are eight different geometrical configurations, each being shown in the upper half of each of the eight cards in FIG. 1. Thus, the upper half of each card illustrates; a hexagon in card 11 (this card being the same as illustrated in FIG. 2); a circle in card 12; an ellipse in card 13; a semi-circle in card 14; a larger circle in card 15; another circle (larger and of a different color than the circle in card 12) in card 15; a non-square quadralateral in card 16; a square in card 17; and a triangle in card 18. Preferably, the different geometrical shapes are of different colors.

As also shown in FIG. 1, the geometrical configuration on the opposite side of each card is different from each other, but is the same as the indicia on some, but not all, of the other cards of the set. Thus, the bottom half of card 11 includes an ellipse corresponding to top half of card 13, and the bottom half of card 12 includes a non-square quadrilateral corresponding to the top half of card 16.

Since there are a total of 56 cards in each set, and each set includes eight different geometrical configurations (as illustrated in the top halves of the cards 11–18 in FIG. 1), and since each card includes two geometrical configurations, a complete set will have 112 geometrical configurations, and each geometrical configuration will appear 14 times, i.e. seven times in the upper halves of the cards and seven times in the lower halves of the cards.

A valid card pair or trick is produced when two cards are inserted into each other via their respective slits 2 such that the geometrical configurations of the two cards exposed to view are the same. FIG. 3*a* illustrates a valid card pair or trick, in which the circle in the upper half of card 12 of FIG. 1 is the same as, and therefore matches, the circle in the lower half of another card, therein designated 21, paired together by inserting one into the other via their respective slits 2. FIG. 3*b* illustrates another valid card pair or trick wherein card 16 of those illustrated in FIG. 1 is paired with another card 22, both cards having a hexagon exposed to view when the two cards are paired by the insertion of one into the other via their slits 2. All other pairs, i.e., those wherein the geometrical configurations exposed to view are not identical, are invalid pairs.

Following is one example of a set of rules for playing a game using the illustrated set of cards, there being 56 cards in a complete set as described above.

The game may be played with two or more players. At the start of the game, four cards are placed face-up on the table.

Each player then, in his turn, picks up one card from the stack and tries to make a valid pair or trick, as described above and as illustrated in FIGS. 3*a* and 3*b*, between the picked-up card and one of the cards on the table. If he can make such a valid pair, he places the pair next to him; but if he cannot make such a valid pair, he places his card face-up as an "open" card next to him.

It is now the next player's turn. If this is his first turn, he of course has no "open" cards, and therefore he takes a card from the stack and tries to make a valid pair or trick with one of the cards on the table and, as the first player, he either produces a valid pair, or an "open" card. If this is not the player's first turn, and the player already has an "open" card from the previous turn, he cannot pick up another card from the stack, but he can play the 37 open" card only with respect to the cards on the table. Thus, no player can take a card from the stack so long as he has an "open" card.

The game ends when all the players have "open" cards, or when all the cards in the stack have been played. The player having the most valid pairs or tricks wins.

The rules may further specify that if a player, in his turn, touches a card on the table to attempt to make a valid pair, this commits the player, and if he does not succeed in making the matched pair, he loses his next turn. This is to force the player to visualize the required relationship between his card and those on the table, without actually manipulating the cards, in order to determine whether a valid pair exists.

The above-described rules merely set forth the basic idea of a game to be played with the illustrated set of cards. It will be appreciated that further specific rules could be included, or that the illustrated set of cards could be used to play games according to other rules.

FIGS. 4, 5 and 6 illustrate cards having other types of indicia on the cards which are to be matched to produce a valid card pair or trick when the indicia on one card of the pair is validly complementary with the indicia on the other card of the pair in the two cards which have been inserted into each other via their slits 2, with one half of one card aligned with and exposed to view with the other half of the other card, as illustrated in FIGS. 3*a* and 3*b*.

Thus, FIG. 4 illustrates only two cards of a set wherein the indicia on each half of each card illustrates one-half of an object, the two indicia on the two halves of a valid card pair or trick illustrating a complete one of a plurality of different objects. Thus, card 100 illustrates, on its upper half, indicia 101 representing one-half of a mouse, and on its lower half, indicia 102 representing one-half of a bird. The complete objects illustrated by the indicia on the two halves of the respective card are shown in the corners of the respective card half; thus, card 100 of FIG. 4 also includes an illustration 103 of a complete mouse in the upper right-hand corner, and an illustration 104 of a complete bird in the lower left-hand corner.

Card 110 in FIG. 4 includes indicia 111 on its upper half representing one-half of a flower, and indicia 112 on its lower half representing one-half of a bird. The complete flower appears at 113 in the upper right corner of the card, and the complete bird appears at 114 at the bottom left corner of the card.

As in the FIGS. 1, 2 embodiment, the complete set of cards in the FIG. 4 embodiment would also include 56 cards and eight different objects, so that the upper half of each object would appear on seven cards, and the lower half of each object would also appear on seven cards. Examples of the other objects, in addition to the mouse, bird and flower illustrated in cards 100 and 110 of FIG. 4, may include a butterfly, bug, banana, moon and star.

FIG. 5 illustrates cards having a different type of indicia, namely mathematical numbers, such that the numbers on the two halves of a valid card pair or trick illustrate a valid mathematical relationship between the numbers. In this example, each card half includes a number from 1–6, and further includes a "+" symbol at its center where its respective slit (2, FIG. 2) is located.

Thus, card 200 includes indicia 201 at its upper half representing a "4", and indicia 202 at lower half representing a "5", with a "+" symbol 203 at its center; and card 210 includes indicia 211 at its upper half representing a "2", indicia 212 at its lower half representing an "8", and a "+" symbol 213 at its center.

The rules may provide that a valid matched pair or trick is produced when the two cards can be inserted into each other via their slits, to equal a certain sum, e.g., "10," or a higher number. Thus, cards 200 and 210 illustrated in FIG. 5 could be used for producing a valid matched pair or trick by inserting the cards so that the number "5" of indicia 202 is aligned with and exposed with the number "8" of indicia 212. The set could also include 56 cards, numbered from "1" to "8" on each of their opposite halves so that each number would appear several times on each card-half of a complete set.

FIG. 6 illustrates a still further variation wherein the indicia on each half of each card illustrates a plurality of letters forming an incomplete word, the letters on the two halves of a valid card pair constituting the letters of one or more complete words. Thus, card 300 includes two groups 301 and 302 of letters on its upper half, and two groups 303 and 304 of letters on its lower half; and similarly card 310 includes two groups 311 and 312 of letters on its upper half, and two groups 313 and 314 of letters on its lower half. As in the previously described embodiments, there would be, for example, 56 such cards, but in this case all the cards would have different letters to be matched to form words. Thus, card 310 could be inserted into card 300 so as to align the letters of groups 301 and 303 with the letters of groups 311 and 313, and the letters of groups 302 and 304 with the letters of groups 312 and 314. In such a combination, the letters of the aligned groups 301, 303, 311 and 313 would form the word "brush", "bush", "bus" and "rush", and the letters of the aligned group 302, 304, 312, 314, would form the words "fort", "for", and "rot" in one disposition, and the other words in the other disposition.

This version of the card game provides many more possibilities of combinations, and therefore requires the exercise of more skill and imagination in forming the valid card pairs or tricks. The winner of the game would be the one that has formed valid card pairs which include the largest number of words.

While the invention has been described with respect to several preferred embodiments, it will be appreciated that many other variations, modifications and applications of the invention may be made.

What is claimed is:

1. A card game comprising a set of cards;

each card being formed with a slit along its mid-line starting from one edge and extending for about one-half its width towards its opposite edge such as to permit each card to be inserted via its slit into the slit of each other card in the set to form a pair with one-half of one card aligned with and exposed to view with the other half of the other card;

each card having indicia on each half of the card on opposite sides of its respective slit;

the indicia on the half of each card on one side of the slit being non-validly complementary with the indicia on the other half of the card on the other side of its slit, but being validly complementary with the indicia on some, but not all, of the other cards of the set to form a valid card pair therewith when the two cards are inserted into each other via their respective slits.

2. The card game according to claim 1, wherein the indicia on each half of each card illustrates a geometrical configuration, the two geometrical configurations on the two halves of a valid card pair being the same.

3. The card game according to claim 2, wherein the card set includes more than five different geometrical configurations.

4. The card game according to claim 2, wherein the card set includes at least eight different geometrical configurations.

5. The card game according to claim 1, wherein the indicia on each half of each card illustrates one-half of an object, the two indicia on the two halves of a valid card pair illustrating a complete one of a plurality of different objects.

6. The card game according to claim 5, wherein the indicia of all the valid card pairs in the set of cards illustrate more than five different objects.

7. The card game according to claim 5, wherein the indicia of all the valid card pairs in the set of cards illustrate at least eight different objects.

8. The card game according to claim 1, wherein the indicia on each half of each card represents a mathematical number, the two numbers on the two halves of a valid card pair illustrating a valid mathematical relationship between said numbers.

9. The card game according to claim 8, wherein said valid mathematical relationship is a predetermined sum of two numbers each number being illustrated in the indicia of one-half of each card of a valid card pair.

10. The card game according to claim 1, wherein the indicia on each half of each card illustrate a plurality of letters forming an incomplete word, the letters on the two halves of a valid card pair constituting the letters of one or more complete words.

11. The card game according to claim 10, wherein the letters of all the valid card pairs in the set of cards illustrate the letters of at least eight different words.

12. The card game according to claim 1, wherein said card set includes at least 56 cards.

13. The card game according to claim 1, wherein the slit in each card is formed with outwardly tapered edges to facilitate inserting one card into another.

14. The card game according to claim 1, wherein the slit in each card terminates at its inner edge in a further slit extending perpendicularly thereto.

15. A card game comprising a set of cards;

each card being formed with a slit along its mid-line starting from one edge and extending for about one-half its width towards its opposite edge such as to permit each card to be inserted via its slit into the slit of each other card in the set to form a pair with one-half of one card aligned with and exposed to view with the other half of the other card;

the slit in each card being formed with outwardly tapered edges to facilitate inserting one card into another;

each card having indicia on each half of the card on opposite sides of its respective slit;

the indicia on the half of each card on one side of the slit being non-validly complementary with the indicia on the other half of the card on the other side of its slit, but being validly complementary with the indicia on some, but not all, of the other cards of the set to form a valid card pair therewith when the two cards are inserted into each other via their respective slits.

16. The card game according to claim 15, wherein the slit in each card terminates at its inner edge in a further slit extending perpendicularly thereto.

17. The card game according to claim 16, wherein the indicia on each half of each card illustrates a geometrical configuration, the two geometrical configurations on the two halves of a valid card pair being the same.

18. The card game according to claim 17, wherein the card set includes more than five different geometrical configurations.

19. The card game according to claim 17, wherein the card set includes at least eight different geometrical configurations.

20. The card game according to claim 17, wherein the indicia on each half of each card illustrates one-half of an object, the two indicia on the two halves of a valid card pair illustrating a complete one of a plurality of different objects.

* * * * *